US011767607B1

(12) United States Patent
Krishnamurthy et al.

(10) Patent No.: US 11,767,607 B1
(45) Date of Patent: Sep. 26, 2023

(54) METHOD OF DEPOSITING A METAL LAYER ON A COMPONENT

(71) Applicant: General Electric Company, Schenectady, NY (US)

(72) Inventors: Sriram Krishnamurthy, Bengaluru (IN); Lakshmi Krishnan, Clifton Park, NY (US); Elzbieta Kryj-Kos, Liberty Township, OH (US); Justin M. Welch, Johnsonville, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/863,485

(22) Filed: Jul. 13, 2022

(51) Int. Cl.
*C25D 5/54* (2006.01)
*C25D 5/56* (2006.01)
*C25D 7/00* (2006.01)

(52) U.S. Cl.
CPC *C25D 5/56* (2013.01); *C25D 7/00* (2013.01)

(58) Field of Classification Search
CPC .... C25D 5/54; C25D 5/56; C25D 7/00; C23C 18/165
USPC ..... 205/161, 162, 164, 183, 205, 208
See application file for complete search history.

(56) References Cited

U.S. PATENT DOCUMENTS 2,637,405 A 5/1953 Stanley
2,959,229 A 11/1960 Meier
2,990,309 A 6/1961 Wahl et al.
3,028,292 A 4/1962 Hinds
3,088,192 A 5/1963 Turner
3,369,782 A 2/1968 Billig et al.
3,464,898 A 9/1969 Norris
3,476,625 A 11/1969 Slivinsky et al.
3,554,875 A 1/1971 MacKinney et al.
3,616,433 A 10/1971 Williams
3,637,325 A 1/1972 Morley
3,762,835 A 10/1973 Carlson et al.
3,892,612 A 7/1975 Carlson et al.
3,923,421 A 12/1975 Carter et al.
4,275,994 A 6/1981 Underhill, Jr.
4,329,119 A 5/1982 Baskin
4,648,921 A 3/1987 Nutter
4,706,910 A 11/1987 Walsh et al.
4,786,015 A 11/1988 Niggemann
(Continued)

FOREIGN PATENT DOCUMENTS

DE 2947247 A1 5/1981
EP 2182096 A1 5/2010
(Continued)

OTHER PUBLICATIONS

Ebnesajjad, "Surface Preparation of Thermoplastics, Thermosets, and Elastomers," Handbook of Adhesives and Surface Preparation (Jan. 1, 2011 ), pp. 107-134. (Year: 2011).*
(Continued)

*Primary Examiner* — Edna Wong
(74) *Attorney, Agent, or Firm* — Dority & Manning, P.A.

(57) ABSTRACT

A method for depositing a metal layer on a component is provided. The method includes applying an electrically conductive coating composition including a resin and metal particles on a coating region of the component; at least partially curing the resin forming an electrically conductive coating; and depositing, via an electrodeposition process, a metal layer on the electrically conductive coating.

19 Claims, 7 Drawing Sheets

(56) References Cited

U.S. PATENT DOCUMENTS

| | | | |
|---|---|---|---|
| 4,986,496 | A | 1/1991 | Marentic et al. |
| 5,133,519 | A | 7/1992 | Falco |
| 5,306,120 | A | 4/1994 | Hammer et al. |
| 5,368,711 | A | 11/1994 | Poris |
| 5,386,955 | A | 2/1995 | Savill |
| 5,449,273 | A | 9/1995 | Hertel et al. |
| 5,486,096 | A | 1/1996 | Hertel et al. |
| 5,674,370 | A | 10/1997 | DuPree |
| 5,803,409 | A | 9/1998 | Keefe |
| 5,881,972 | A | 3/1999 | Smith et al. |
| 5,908,285 | A | 6/1999 | Graff |
| 6,050,523 | A | 4/2000 | Kraenzien |
| 6,207,034 | B1 | 3/2001 | Madden et al. |
| 6,221,230 | B1 | 4/2001 | Takeuchi et al. |
| 6,290,895 | B1 | 9/2001 | Wang et al. |
| 6,447,254 | B1 | 9/2002 | Holowczak et al. |
| 6,620,519 | B2 | 9/2003 | Modi |
| 6,655,633 | B1 | 12/2003 | Chapman, Jr. |
| 6,689,269 | B1 | 2/2004 | Schuster et al. |
| 6,905,307 | B2 | 6/2005 | Kawarada et al. |
| 7,013,551 | B2 | 3/2006 | Green et al. |
| 7,063,763 | B2 | 6/2006 | Chapman, Jr. |
| 7,070,850 | B2 | 7/2006 | Dietz et al. |
| 7,435,324 | B2 | 10/2008 | Ramarajan et al. |
| 7,510,778 | B2 | 3/2009 | Bernard et al. |
| 7,615,141 | B2 | 11/2009 | Schwartz et al. |
| 7,805,839 | B2 | 10/2010 | Cammer |
| 7,955,486 | B2 | 6/2011 | Yu et al. |
| 8,684,310 | B2 | 4/2014 | Rawlings et al. |
| 9,234,351 | B1 | 1/2016 | Echelman |
| 9,249,666 | B2 | 2/2016 | Wood et al. |
| 9,453,418 | B2 | 9/2016 | Hui et al. |
| 9,481,451 | B2 | 11/2016 | Rawlings et al. |
| 9,482,095 | B2 | 11/2016 | Drane |
| 9,551,294 | B2 | 1/2017 | Czapski, Jr. et al. |
| 9,657,576 | B2 | 5/2017 | Ramm et al. |
| 9,664,201 | B2 | 5/2017 | Dudon et al. |
| 9,677,186 | B2 | 6/2017 | Braun et al. |
| 9,745,851 | B2 | 8/2017 | Li et al. |
| 9,920,431 | B2 | 3/2018 | Dudon et al. |
| 10,227,704 | B2 | 3/2019 | Twelves et al. |
| 10,294,573 | B2 | 5/2019 | Parkos, Jr. et al. |
| 10,364,823 | B2 | 7/2019 | Guglielmin et al. |
| 10,450,867 | B2 | 10/2019 | Bunker |
| 10,539,025 | B2 | 1/2020 | Kray et al. |
| 10,760,600 | B2 | 9/2020 | Watson et al. |
| 11,268,526 | B2 | 3/2022 | Roach et al. |
| 2001/0015043 | A1 | 8/2001 | Brenneis et al. |
| 2003/0031564 | A1 | 2/2003 | Kawarada et al. |
| 2005/0205644 | A1 | 9/2005 | Meier |
| 2006/0018760 | A1 | 1/2006 | Bruce et al. |
| 2006/0049038 | A1 | 3/2006 | Griego et al. |
| 2007/0251825 | A1 | 11/2007 | Kenney |
| 2008/0124512 | A1 | 5/2008 | Steibel et al. |
| 2008/0268258 | A1 | 10/2008 | Verma et al. |
| 2010/0014964 | A1 | 1/2010 | Smith et al. |
| 2010/0054945 | A1 | 3/2010 | McMillan et al. |
| 2010/0148006 | A1 | 6/2010 | Olmi et al. |
| 2010/0232974 | A1 | 9/2010 | De Moura et al. |
| 2011/0097213 | A1 | 4/2011 | Peretti et al. |
| 2011/0211967 | A1 | 9/2011 | Deal et al. |
| 2011/0262705 | A1 | 10/2011 | Gupta et al. |
| 2012/0082541 | A1 | 4/2012 | Macchia et al. |
| 2012/0163981 | A1 | 6/2012 | Hong |
| 2013/0082142 | A1 | 4/2013 | Li et al. |
| 2013/0146217 | A1 | 6/2013 | Kray et al. |
| 2013/0156592 | A1 | 6/2013 | Kray et al. |
| 2013/0164488 | A1 | 6/2013 | Wood et al. |
| 2013/0199934 | A1 | 8/2013 | Parkos, Jr. et al. |
| 2014/0133987 | A1 | 5/2014 | Guinaldo Fernandez et al. |
| 2014/0202170 | A1 | 7/2014 | Cook, III |
| 2015/0048209 | A1 | 2/2015 | Hoyt et al. |
| 2015/0063903 | A1 | 3/2015 | Matthews et al. |
| 2015/0086378 | A1 | 3/2015 | Klein et al. |
| 2015/0104323 | A1 | 4/2015 | Franchet et al. |
| 2015/0184306 | A1 | 7/2015 | Parkos, Jr. et al. |
| 2015/0298787 | A1 | 10/2015 | Nordin et al. |
| 2015/0361802 | A1 | 12/2015 | Yoshida et al. |
| 2016/0017509 | A1 | 1/2016 | Agustoni |
| 2016/0152005 | A1 | 6/2016 | Roach et al. |
| 2016/0169012 | A1 | 6/2016 | DuCunha et al. |
| 2016/0243586 | A1 | 8/2016 | Travis |
| 2016/0271930 | A1 | 9/2016 | Roper et al. |
| 2016/0312035 | A1 | 10/2016 | Song |
| 2016/0318603 | A1 | 11/2016 | Rawlings et al. |
| 2016/0345430 | A1 | 11/2016 | Khan et al. |
| 2017/0043562 | A1* | 2/2017 | Chatzi ..... B32B 27/14 |
| 2017/0044680 | A1 | 2/2017 | Sundaram |
| 2017/0100877 | A1 | 4/2017 | Song |
| 2017/0101878 | A1 | 4/2017 | Wang et al. |
| 2017/0137116 | A1 | 5/2017 | Ireland et al. |
| 2017/0145578 | A1 | 5/2017 | Wirth et al. |
| 2017/0167510 | A1 | 6/2017 | Berschback et al. |
| 2018/0015996 | A1 | 1/2018 | Shemkunas et al. |
| 2018/0022438 | A1 | 1/2018 | Cresp Pena et al. |
| 2018/0178461 | A1 | 6/2018 | Kim et al. |
| 2018/0312987 | A1 | 11/2018 | Jonnalagadda et al. |
| 2019/0017185 | A1 | 1/2019 | Takshi et al. |
| 2019/0055661 | A1 | 2/2019 | Huang |
| 2020/0102835 | A1 | 4/2020 | Bryant, Jr. |
| 2020/0109480 | A1 | 4/2020 | Sridharan et al. |
| 2020/0190681 | A1 | 6/2020 | Tajiri et al. |
| 2022/0106885 | A1 | 4/2022 | Cheung |
| 2022/0307380 | A1* | 9/2022 | Kryj-Kos ..... F01D 9/041 |

FOREIGN PATENT DOCUMENTS

| | | | | |
|---|---|---|---|---|
| GB | 1213821 | A | 11/1970 | |
| JP | S5257038 | A | 5/1977 | |
| JP | H2135795 | U | 11/1990 | |
| JP | 2008/510889 | A | 4/2008 | |
| WO | WO2014/128898 | A1 | 8/2014 | |
| WO | WO-2015006438 | A1 * | 1/2015 | ..... C23C 18/1641 |
| WO | WO2015/042089 | A1 | 3/2015 | |

OTHER PUBLICATIONS

Co-Pending U.S. Appl. No. 17/389,945, filed Jul. 30, 2021.

Integran, Trying to Break the Highly Durable Colt Hockey Stick, 2 Pages. Retrieved May 11, 2022 from weblink: https://www.integran.com/post/trying-to-break-the-highly-durable-colt-hockey-stick.

Volgin et al. Effect of Anode Shape on Uniformity of Electrodeposition onto Resistive Substrates, ScienceDirect, Electrochimica Acts, vol. 230, Mar. 10, 2017, pp. 382-390. (Abstract Only).

* cited by examiner

METHOD OF DEPOSITING A METAL LAYER ON A COMPONENT

FIELD

The present disclosure relates to a method for depositing a metal layer on a component, or more particularly a method of depositing a metal edge on an airfoil for a gas turbine engine.

BACKGROUND

A gas turbine engine generally includes a fan and a turbomachine arranged in flow communication with one another. Additionally, the turbomachine of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gases through the turbine section drives the turbine section and is then routed through the exhaust section, e.g., to atmosphere.

The fan includes a plurality of circumferentially spaced fan blades extending radially outward from a rotor disk. Rotation of the fan blades creates an airflow through the inlet to the turbomachine, as well as an airflow over the turbomachine. For certain gas turbine engines, a plurality of outlet guide vanes are provided downstream of the fan for straightening the airflow from the fan to increase, e.g., an amount of thrust generated by the fan.

Improvements to the airfoils, and other outlet guide vanes within the gas turbine engine, would be welcomed in the art.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
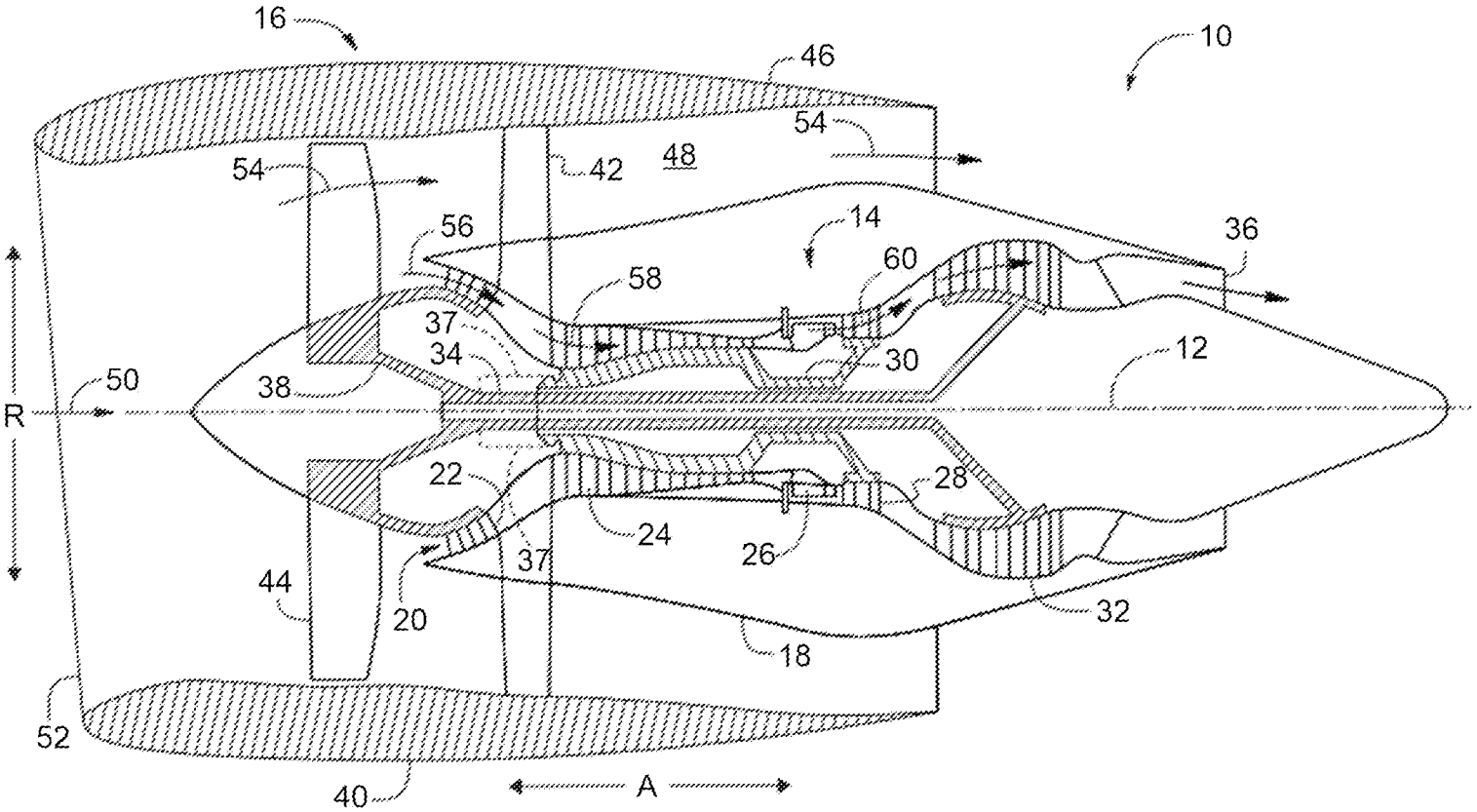
FIG. 1 illustrates a cross-sectional view of one embodiment of a gas turbine engine that may be utilized within an aircraft in accordance with aspects of the present subject matter, particularly illustrating the gas turbine engine configured as a high-bypass turbofan jet engine.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The singular forms "a", "an", and "the" include plural references unless the context clearly dictates otherwise.

The term "at least one of" in the context of, e.g., "at least one of A, B, and C" refers to only A, only B, only C, or any combination of A, B, and C.

The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, the term "aspect ratio" of a particle refers to the length of the largest caliper diameter of the particle divided by the length of the smallest caliper diameter of that same particle. For example, a circular particle would have an equal length all around the particle, and thus would have an aspect ratio of 1. In another example, a microparticle having a caliper diameter in its largest dimension of 100 micrometers (μm) and a caliper diameter in its smallest dimension of 10 μm would have an aspect ratio of 10 (i.e., 100 μm divided by 10 μm is 10). It is noted that the aspect ratio is agnostic to measurement units, as the formula cancels out the particular units utilized to measure the length, as long as the measuring units are the same.

In the present disclosure, when a layer is being described as "on" or "over" another layer or substrate, it is to be understood that the layers can either be directly contacting each other or have another layer or feature between the layers, unless expressly stated to the contrary. Thus, these terms are simply describing the relative position of the layers to each other and do not necessarily mean "on top of" since the relative position above or below depends upon the orientation of the device to the viewer.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

The present disclosure is generally related to a method for depositing a metal layer on a component, such as an airfoil for use in a gas turbine engine. To make the engine more efficient, airfoils are fabricated from lighter weight materials, such as polymer foams, ceramic matrix composite materials, or polymer matrix composite materials. Typically, a metal shell or edge is placed on the leading edge of the airfoil to protect the leading edge from damage. Methods for applying the metal edge to the airfoil utilize adhesive to adhere a preformed metal edge to the airfoil. However, geometry of the leading edge can include several peaks and valleys, which makes it difficult to adhere preformed metal edges to the leading edge. Accordingly, the method disclosed herein utilizes an electrically conductive coating that facilitates deposition of a metal layer directly on the airfoil itself.

Referring now to the drawings, FIG. 1 illustrates a cross-sectional view of one embodiment of a gas turbine engine 10 that may be utilized within an aircraft in accordance with aspects of the present subject matter. More particularly, for the embodiment of FIG. 1, the gas turbine engine is a high-bypass turbofan jet engine, with the gas turbine engine 10 being shown having a longitudinal or axial centerline axis 12 extending therethrough along an axial direction A for reference purposes. The gas turbine engine 10 further defines a radial direction R extended from the centerline 12. Although an exemplary turbofan embodiment is shown, it is anticipated that the present disclosure can be equally applicable to turbomachinery in general, such as an open rotor turbofan engine (e.g., a turbofan without an outer nacelle), a turboshaft, turbojet, or a turboprop configuration, including marine and industrial turbine engines and auxiliary power units.

In general, the gas turbine engine 10 includes a turbomachine 14 and a fan section 16 positioned upstream thereof. The turbomachine 14 generally includes a substantially tubular outer casing 18 that defines an annular inlet 20. In addition, the outer casing 18 may further enclose and support a low pressure (LP) compressor 22 for increasing the pressure of the air that enters the turbomachine 14 to a first pressure level. A multi-stage, axial-flow high pressure (HP) compressor 24 may then receive the pressurized air from the LP compressor 22 and further increase the pressure of such air. The pressurized air exiting the HP compressor 24 may then flow to a combustor 26 within which fuel is injected into the flow of pressurized air, with the resulting mixture being combusted within the combustor 26. The high energy combustion products are directed from the combustor 26 along the hot gas path of the gas turbine engine 10 to a high pressure (HP) turbine 28 for driving the HP compressor 24 via a high pressure (HP) shaft 30 or spool, and then to a low pressure (LP) turbine 32 for driving the LP compressor 22 and fan section 16 via a low pressure (LP) shaft 34 or spool that is generally coaxial with HP shaft 30. After driving each of turbines 28 and 32, the combustion products may be expelled from the turbomachine 14 via an exhaust nozzle 36 to provide propulsive jet thrust.

Additionally, the fan section 16 of the gas turbine engine 10 generally includes a rotatable, axial-flow fan rotor 38 configured to be surrounded by an annular fan casing 40. In particular embodiments, the LP shaft 34 may be connected directly to the fan rotor 38, such as in a direct-drive configuration. In alternative configurations, the LP shaft 34 may be connected to the fan rotor 38 via a speed reduction device 37 such as a reduction gear gearbox in an indirect-drive or geared-drive configuration. Such speed reduction devices may be included between any suitable shafts/spools within the gas turbine engine 10 as desired or required.

It should be appreciated by those of ordinary skill in the art that the fan casing 40 may be configured to be supported relative to the turbomachine 14 by a plurality of substantially radially-extending, circumferentially-spaced outlet guide vanes 42. As such, the fan casing 40 may enclose the fan rotor 38 and its corresponding fan rotor blades (fan blades 44). Moreover, a downstream section 46 of the fan casing 40 may extend over an outer portion of the turbomachine 14 so as to define a secondary, or by-pass, airflow conduit 48 that provides additional propulsive jet thrust.

During operation of the gas turbine engine 10, it should be appreciated that an initial airflow (indicated by arrow 50) may enter the gas turbine engine 10 through an associated inlet 52 of the fan casing 40. The air flow 50 then passes through the fan blades 44 and splits into a first compressed air flow (indicated by arrow 54) that moves through the by-pass conduit 48 and a second compressed air flow (indicated by arrow 56) which enters the LP compressor 22. The pressure of the second compressed air flow 56 is then increased and enters the HP compressor 24 (as indicated by arrow 58). After mixing with fuel and being combusted within the combustor 26, the combustion products 60 exit the combustor 26 and flow through the HP turbine 28. Thereafter, the combustion products 60 flow through the LP turbine 32 and exit the exhaust nozzle 36 to provide thrust for the gas turbine engine 10.

Figure 2A:
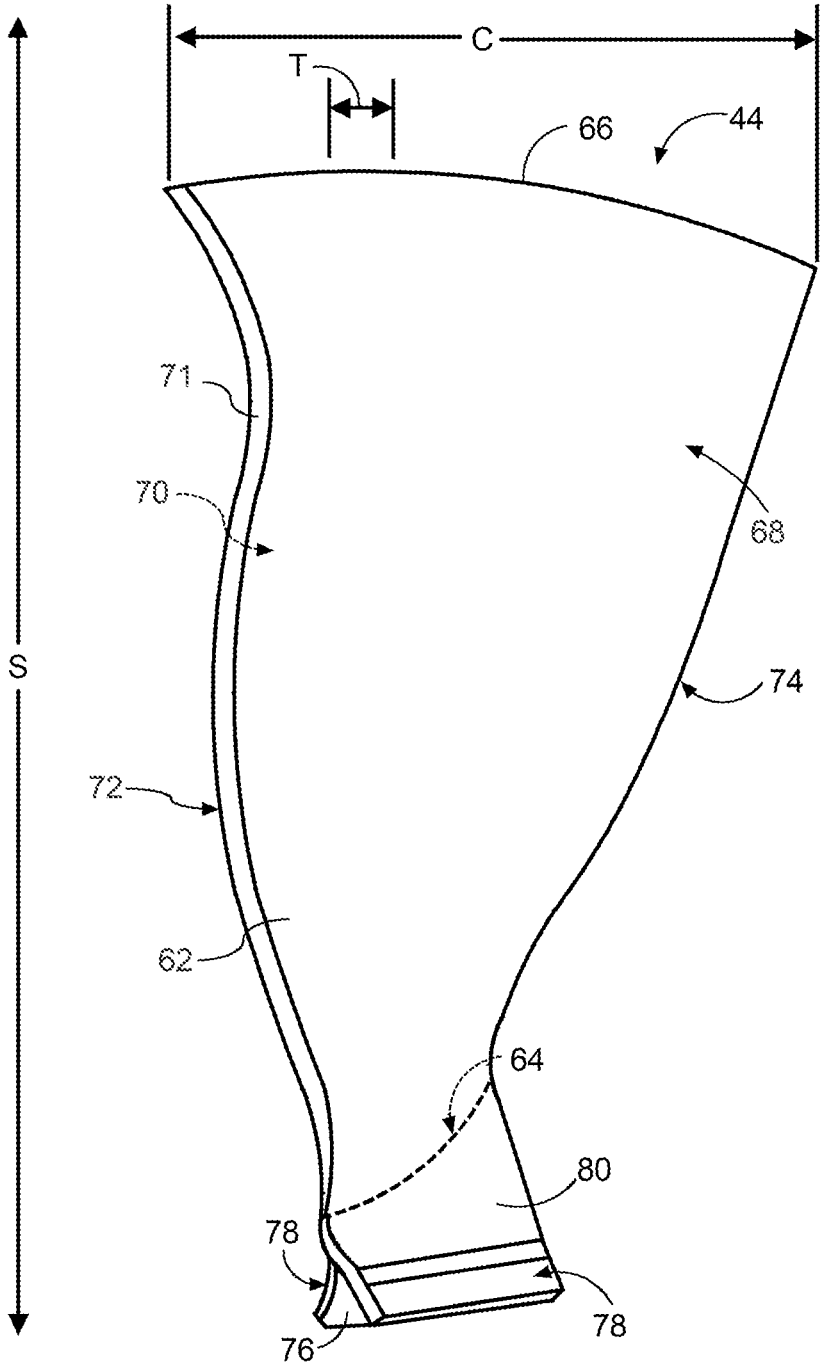
FIG. 2A illustrates a fan blade of the fan section of FIG. 1 in accordance with aspects of the present subject matter.
Figure 2B:
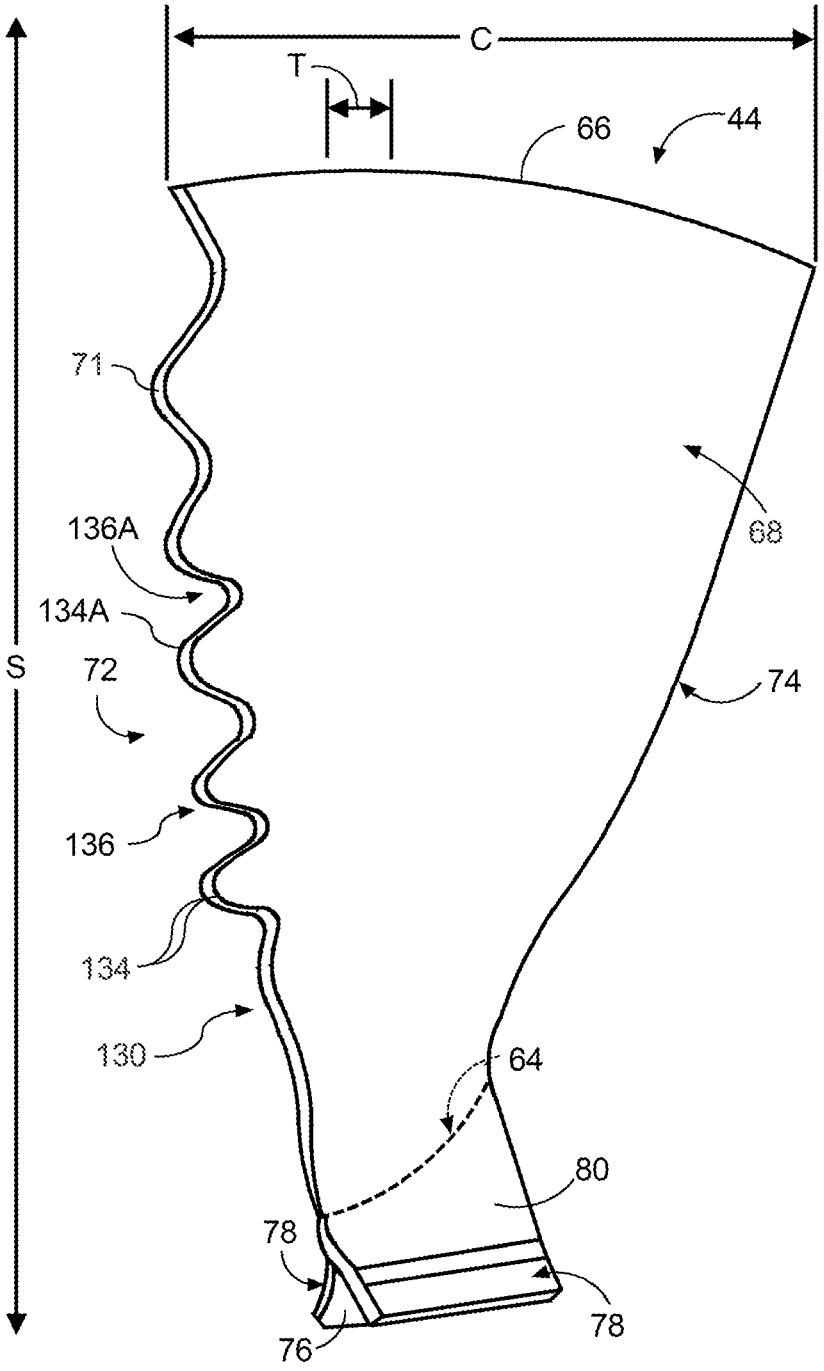
FIG. 2B illustrates an airfoil in accordance with aspects of the present subject matter.

Referring now to FIGS. 2A and 2B, an exemplary airfoil 62 for a fan blade 44 is shown. Optionally, each fan blade 44 includes an integral component having an axial dovetail 76 with a pair of opposed pressure faces 78 leading to a transition section 80. The fan blade 44 extends radially outwardly along a span defining a spanwise direction S from an airfoil root 64 to an airfoil tip 66. A pressure side 68 and a suction side 70 of the airfoil 62 extend from the airfoil's leading edge 72 to a trailing edge 74 and between the airfoil root 64 and airfoil tip 66 along the span. Further, it should be recognized that airfoil 62 may define a chordwise direction C along a chord at each point along the span and extending between the leading edge 72 and the trailing edge 74. Further, the chord may vary along the span of the airfoil 62. For instance, in the depicted embodiment, the chord increases along the span toward the airfoil tip 66. Though, in other embodiments, the chord may be approximately constant throughout the span or may decrease from the airfoil root 64 to the airfoil tip 66.

The airfoil 62 may define a thickness direction T along a thickness extending between the pressure side 68 and the suction side 70 at each point along the span. In certain embodiments, the thickness may be approximately constant throughout the span of the airfoil 62. In other embodiments, the airfoil 62 may define a variable thickness between the airfoil root 64 and the airfoil tip 66. For instance, the thickness may generally decrease along the span toward the airfoil tip 66. Additionally, the airfoil 62 may define an approximately constant thickness along the chord at each point along the span. Or, in other embodiments, at least one point along the span of the airfoil 62 may define a variable thickness along the chord. For instance, the airfoil 62 may define a maximum thickness at a position along the chord at each point along the span. A metallic leading edge shield 71 may cover an axially extending portion of the airfoil 62 including at least a portion of the leading edge 72. In other embodiments, the metallic leading edge shield 71 may also cover portions of the tip 66 and the trailing edge 74 (not shown in FIG. 2). The metallic leading edge shield 71 can be formed according to methods provided herein as will be further discussed below.

The airfoil 62 as illustrated in FIG. 2B, includes a nonlinear patterned leading edge 72. For example, for the embodiments shown, the nonlinear patterned leading edge 72 is a waived leading edge 130 defining a plurality of peaks 134 and a plurality of valleys 136 alternatingly arranged along the spanwise direction S.

A size, density, and number of the plurality of peaks 134 and the plurality of valleys 136 at the leading edge 72 of the airfoil 62 may be chosen to, e.g., minimize noise attenuation during operation of the gas turbine engine. For example, in certain embodiments, the plurality of peaks 134 may include at least three peaks 134, such as at least four peaks 134, such as at least five peaks 134, such as up to twenty-five (25) peaks 134, such as up to twenty (20) peaks 134, such as up to fifteen (15) peaks 134, such as up to ten (10) peaks 134.

There may be a similar number of valleys 136, with each valley 136 positioned between adjacent peaks 134.

Further, for the embodiment shown, it will be appreciated that the plurality of peaks 134 includes a first peak 134A and the plurality of valleys 136 includes a first valley 136A adjacent to the first peak 134A. In such a manner, it will be appreciated that the waived leading edge 72 may be capable of reducing noise attenuation from, e.g., a fan section of an engine incorporating the exemplary airfoils. Notably, as discussed further herein below, a metal layer 120 can be deposited on such a waived leading edge 130 geometry as described and illustrated in FIG. 2B.

Figure 3:
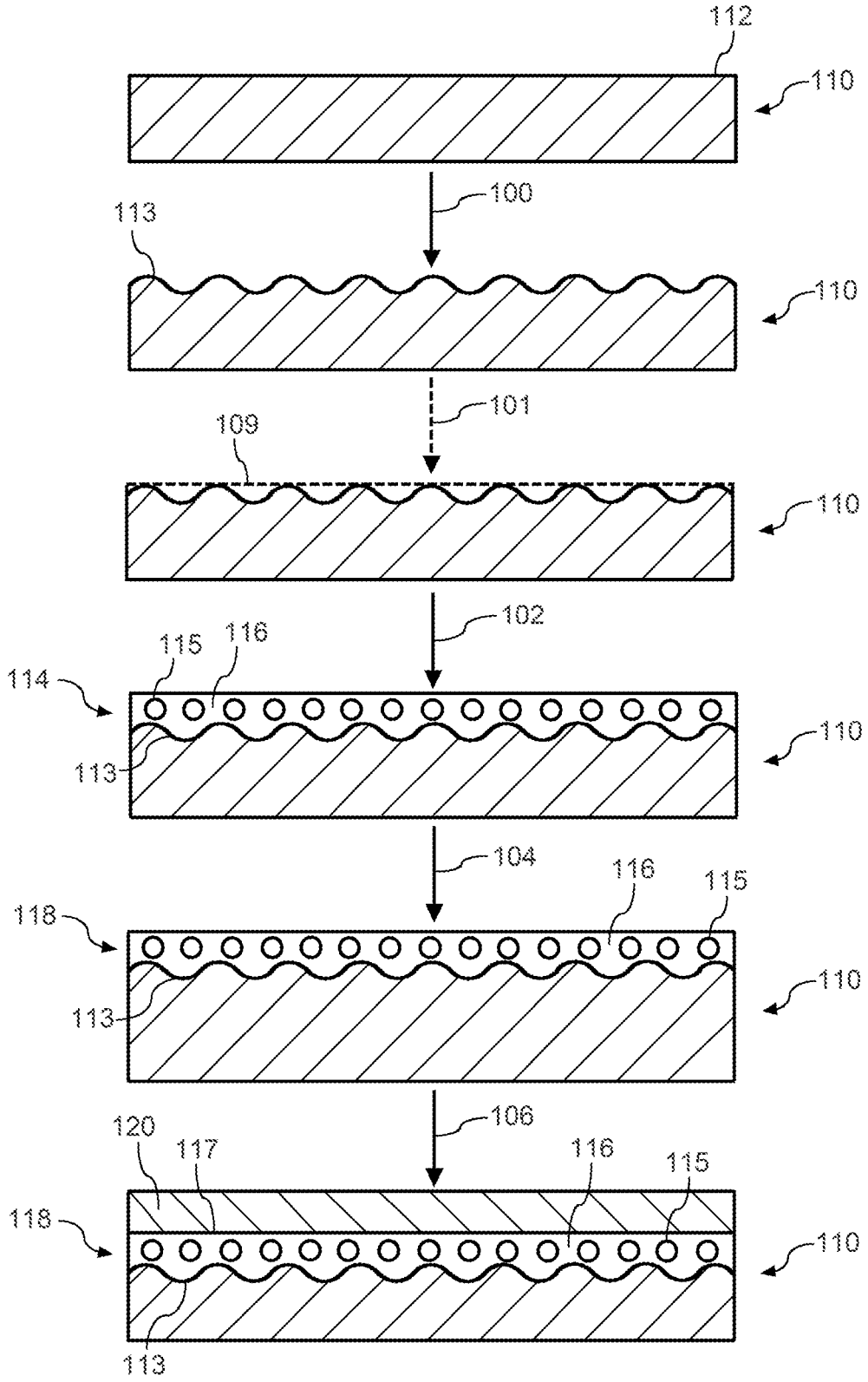
FIG. 3 illustrates a cross-sectional view of a method for coating a component in accordance with aspects of the present subject matter.

FIG. 3 illustrates a cross-sectional view of a component 110 that is coated with a metal layer 120 according to an exemplary method of the present disclosure. For example, the component 110 can include an exemplary airfoil as illustrated with respect to FIG. 2 hereinabove. Specifically, the method provided herein can be used to form the metallic leading edge shield on the leading edge of the airfoil of FIG. 2. While an exemplary airfoil component is provided, the disclosure is not so limited, and the component can include other guide vanes or stator vanes within a gas turbine engine.

The component 110 or a portion of the component 110 to be coated may be formed from a foam material, a honeycomb income material, or both. The foam may be a relatively low density foam, having a relatively high strength and shear stiffness. For example, the foam may have a density between fifteen (15) pounds per cubic foot (0.24 g/cm$^3$) and one (1) pound per cubic foot (0.016 g/cm$^3$). For example, the foam may have a density between thirteen (13) pounds per cubic foot (0.21 g/cm$^3$) and four (4) pounds per cubic foot (0.064 g/cm$^3$), such as between twelve (12) pounds per cubic foot (0.19 g/cm$^3$) and six (6) pounds per cubic foot (0.096 g/cm$^3$). Further, in certain exemplary embodiments the foam chosen may be a relatively stiff foam, defining a shear stiffness (or modulus of rigidity) greater than 15 pounds per square inch (psi) (103.42 kPa), such as greater than 18 psi (124.10 kPa), such as greater than 23 psi (158.58 kPa), such as greater than or equal to 28 psi (193.05 kPa) and less than 100 psi (689.48 kPa).

Notably, however, in other exemplary embodiments, the component 110 may be formed of a material having a greater density, such as a density of 80 pounds per cubic feet or less, such as a density of 70 pounds per cubic feet or less. The component 110 may be a solid resin in such a configuration.

Further, still, the foam may define a relatively low Young's modulus (also known as tensile modulus). Specifically, the foam may be formed of material defining a Young's modulus less than one hundred twenty-five (125) thousand pounds per square inch (ksi). For example, the foam may be formed of material defining a Young's modulus less than one hundred (100) ksi, less than seventy-five (75) ksi, or less than sixty (60) ksi. Moreover, the foam may be formed of a material having an elongation at break greater than two and a half (2.5) percent. For example, the foam may be formed of a material having an elongation at break greater than three (3) percent, such as greater than four (4) percent, such as greater than eight (8) percent, such as greater than ten (10) percent. As used herein, the term "elongation at break" refers to a ratio between a changed length and initial length after breakage of a material. The term elongation at break is a measure of a capability of a material to resist changes in shape without crack formation.

In some embodiments, the component 110 may comprise a composite material, such as a polymer matrix composite (PMC) material or a ceramic matrix composite (CMC) material, which has high temperature capability. Composite materials generally comprise a fibrous reinforcement material embedded in matrix material, e.g., a polymer or ceramic matrix material. The reinforcement material serves as a load-bearing constituent of the composite material, while the matrix of a composite material serves to bind the fibers together and act as the medium by which an externally applied stress is transmitted and distributed to the fibers. As used herein, the term "composite" is understood to include, but is not limited to, a PMC, a CMC, and a hybrid composite, e.g., a PMC or CMC in combination with one or more metallic materials or a PMC or CMC in combination with more than one PMC or CMC.

PMC materials are typically fabricated by impregnating a fabric or unidirectional tape with a resin (prepreg), followed by curing. Prior to impregnation, the fabric may be referred to as a "dry" fabric and typically comprises a stack of two or more fiber layers (plies). The fiber layers may be formed of a variety of materials, nonlimiting examples of which include carbon (e.g., graphite), glass (e.g., fiberglass), polymer (e.g., Kevlar®) fibers, and metal fibers. Fibrous reinforcement materials can be used in the form of relatively short, chopped fibers, generally less than two inches in length, and more preferably less than one inch, or long continuous fibers, the latter of which are often used to produce a woven fabric or unidirectional tape. PMC materials can be produced by dispersing dry fibers into a mold, and then flowing matrix material around the reinforcement fibers, or by using prepreg. For example, multiple layers of prepreg may be stacked to the proper thickness and orientation for the part, and then the resin may be cured and solidified to render a fiber reinforced composite part. Resins for PMC matrix materials can be generally classified as thermosets or thermoplastics. Thermoplastic resins are generally categorized as polymers that can be repeatedly softened and flowed when heated and hardened when sufficiently cooled due to physical rather than chemical changes. Notable example classes of thermoplastic resins include nylons, thermoplastic polyesters, polyaryletherketones, and polycarbonate resins. Specific examples of high performance thermoplastic resins that have been contemplated for use in aerospace applications include polyetheretherketone (PEEK), polyetherketoneketone (PEKK), polyetherimide (PEI), and polyphenylene sulfide (PPS). In contrast, once fully cured into a hard rigid solid, thermoset resins do not undergo significant softening when heated but, instead, thermally decompose when sufficiently heated. Notable examples of thermoset resins include epoxy, bismaleimide (BMI), and polyimide resins. Thus, generally, PMC materials include matrices that are thermoset or thermoplastic and reinforcements that include, but are not limited to, glass, graphite, aramid, or organic fibers of any length, size, or orientation or combination of these reinforcements, and are further understood to include, but are not limited to, being manufactured by injection molding, resin transfer molding, prepreg tape layup (hand or automated), pultrusion, or any other suitable method for manufacture of a reinforced polymer matrix composite structure or combination of these manufacturing methods.

Exemplary CMC materials may include silicon carbide (SiC), silicon, silica, carbon, or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., 3M's Nextel 440 and 480), and chopped whiskers and fibers (e.g., 3M's Nextel 440 and SAFFIL®), and optionally ceramic particles (e.g., oxides of Si, Al, Zr, Y, and combinations thereof) and inorganic fillers (e.g., pyrophyllite, wollastonite, mica, talc, kyanite, and montmorillonite). For example, in certain embodiments, bundles of the fibers, which may include a ceramic refractory material coating, are formed as a reinforced tape, such as a unidirectional reinforced tape. A plurality of the tapes may be laid up together (e.g., as plies) to form a preform component. The bundles of fibers may be impregnated with a slurry composition prior to forming the preform (e.g., prepreg plies) or after formation of the preform. The preform may then undergo thermal processing, such as a cure or burn-out to yield a high char residue in the preform, and subsequent chemical processing, such as melt-infiltration with silicon, to arrive at a component formed of a CMC material having a desired chemical composition. In other embodiments, the CMC material may be formed as, e.g., a carbon fiber cloth rather than as a tape.

As shown in FIG. 3, at (100) the surface 112 of the component 110 may be prepared before the electrically conductive coating composition 114 is applied. For example, portions of the surface 112 of the component 110 to be coated may be roughened forming a coating region 113 for the component 110. Roughening the surface 112 promotes adhesion of the electrically conductive coating composition 114. While the entire surface 112 is shown as being prepared, the disclosure is not so limited. In fact, a coating region 113 defining only a portion of the surface 112 of the component 110 can be prepared, such that the resulting metal layer 120 only coats a portion of the component 110. For instance, in embodiments where the component 110 is an airfoil, only the leading edge of the airfoil is prepared to form the coating region 113. In embodiments, preparing the coating region 113 includes roughening the surface 112, e.g., by grit blasting and/or hand grinding to create the roughness. Grit blasting may include using a portable grit blast unit and/or a grit blast cabinet. The portable grit blast may be used to direct grit against the surface 112 at a pressure of 50 PSI to 150 PSI (0.34 MPa to 1.03 MPa), such as 75 PSI to 125 PSI (0.51 MPa to 0.86 MPa). Further, in some embodiments, the grit can include particles having an average particle size ranging from 100 μm to 250 μm, at a 100% grit flow (e.g., 340 μin (8.636 μm)), where the grit comprises silica ($SiO_2$). In other embodiments, e.g., where a larger grit blasting unit is used, various grit can be used at different conditions to roughen the surface 112. In some embodiments, the grit blast cabinet may be used to direct grit against the surface 112 at a pressure from 50 PSI to 100 PSI (0.34 MPa to 0.69 MPa), such as 60 PSI to 80 PSI (0.41 MPa to 0.55 MPa). In certain non-limiting embodiments, roughening the surface 112 of the component 110 may create a roughness Ra greater than 50 μin (1.27 μm), greater than 100 μin (2.54 μm), greater than 200 μin (5.08 μm), or greater than 300 μin (7.62 μm). However, it will be appreciated that any other means of roughening the coating region 113 of the component 110 may be used. Preparing the surface 112 of the component 110 may further include using an alcohol wipe to clean the surface 112 after roughening the surface 112.

Optionally, at (101) a non-woven fiber layer 109 can be disposed on the surface 112 of the component 110. The non-woven fiber layer 109 can include any suitable fibers including carbon fibers, glass fibers, and/or aramid fibers. The fibers can be metal coated, or metal materials can be embedded in the non-woven fiber layer 109. Without being bound by any particular theory, the non-woven fiber layer 109 can facilitate bonding of the electrically conductive coating 118 to the component 110. For example, the non-woven fiber layer 109 can act as a filter preventing metal particles 115 in the electrically conductive coating composition 114 from passing to the surface 112 of the component 110, while allowing for resin 116 to seep through to the surface 112 of the component 110. In such embodiments, the metal particles 115 remain towards an outer surface 117 of the electrically conductive coating 118 which can facilitate electrodeposition of the metal layer 120, while the resin 116 is able to form a strong bond with the component 110. The non-woven fiber layer 109 can be disposed on the component 110 either prior to preparation of the surface 112 of the component 110 or after.

At (102), an electrically conductive coating composition 114 is applied to the coating region 113 of the component 110. The electrically conductive coating composition 114 comprises a resin 116 in which metal particles 115 are dispersed. In embodiments, the resin 116 can include a thermoplastic or thermoset resin. Suitable thermoset resins include polyester resins, polyurethanes, melamine resin, epoxy resins, polyimides and bismaleimides, cyanate esters or polycyanurates, furan resins, silicon resins, thiolyte, vinyl ester resins, siloxane, polyamides, polyamideimide, polyesterimide, polyvinyl ester or combinations thereof. In certain embodiments, the thermoset resin is epoxy resin. Specific resins that can be utilized include, epoxy 330, epofix resin, or electrobond 04.

In other embodiments, the resin 116 includes a polymer derived ceramic (PDC). PDCs are made from silicon-based organic precursors by pyrolysis wherein the polymer material is heated slowly over several hours until it converts into the inorganic ceramic material. PDCs are made via a chemical route where an organic transforms into a refractory amorphous ceramic by the removal of hydrogen at high temperatures, such as those ranging from 800° C.-1000° C. These ceramics exhibit outstanding creep and oxidation behavior at temperatures up to 1500° C. Preceramic polymers that can be utilized to produce PDCs include polysiloxanes, including poly(organo)siloxanes such as polyborosiloxanes and polycarbosiloxanes, or polysilazanes such as poly(organosilazanes) and poly(organosilylcarbodiimides).

As noted above, metal particles 115 are dispersed within the resin 116. The metal particles 115 can be formed from a variety of metals or metal alloys including Ni, NiCo, NiMo, CoCr, Co, Cu, their alloys, or combinations thereof. The metal particles 115 utilized herein can be selected based on the composition of the metal layer 120 to be deposited during an electrodeposition process. For example, if the metal layer 120 is Ni, then the metal particles 115 can include nickel-containing compounds such as Ni, NiCo, NiMo, or combinations thereof. Similarly, if the metal layer 120 is Co, then the metal particles 115 can include cobalt-containing compounds, such as CoCr, Co, or combinations thereof. The metal layer 120 can include Ni, NiCo, NiMo, CoCr, Co, Cu, their alloys, or combinations thereof.

Generally, in embodiments, the metal particles 115 are 10 wt. % to 65 wt. % of the electrically conductive coating composition 114, such as 20 wt. % to 55 wt. %, such as 30 wt. % to 40 wt. %, with the resin 116 comprising the remainder. Notably, in embodiments where the weight percentage of the metal particles 115 is low, the metal layer 120 may not adhere sufficiently or bind with enough strength to the coating region 113 of the component 110.

The metal particles 115 can have an average particle diameter of less than 50 microns, such as less than 40 microns, such as less than 30 microns. The metal particles can have an aspect ratio ranging from 1 to 100, such as from 5 to 95, such as from 10 to 90, such as from 15 to 85, such as from 20 to 80, such as from 25 to 75, such as from 30 to 70, such as from 35 to 65, such as from 40 to 60, such as from 45 to 55. Techniques for determining particle sizes are known and include dynamic image analysis, static laser light scattering, dynamic light scattering, and sieve analysis. As noted, utilization of the metal particles 115, in particular the sizes of metal particles 115 as described, ensures that the metal layer 120 bonds with sufficient strength to the coating region 113 of the component 110.

At (104), the electrically conductive coating composition 114 is at least partially cured in order to form an electrically conductive coating 118. "Partially cured" as used herein means that the resin 116 has been cured but has not reached final solid state. Curing of resins involves a process by which the resin is passed from a liquid state, through a gel state before reaching a final solid state. Thus, partially cured can refer to the resin in the gel state. In certain embodiments, partially curing the resin 116 allows for additional metal particles 115 to be applied to and adhere to the resin 116. In certain embodiments, however, the resin 116 can be fully cured to form the electrically conductive coating 118. Notably, the metal particles 115 can be homogenously dispersed within the electrically conductive coating 118 or can be graded throughout the electrically conductive coating 118, as will be further discussed hereinbelow with reference to FIG. 5. For example, in certain embodiments the metal particles 115 can be graded throughout the resin 116 having a higher concentration of metal particles 115 at the outer surface 117 of the electrically conductive coating 118.

At (106), the component 110 having the electrically conductive coating 118 thereon is subject to an electrodeposition process for depositing the metal layer 120 on the electrically conductive coating 118. The electrodeposition process can include any metal forming process that utilizes electrodeposition to form, or grow metal layers onto the component 110. Generally, electrodeposition processes involve the electrochemical transfer of metal ions through an electrolyte to a surface from an anode. For instance, in embodiments, application of the metal layer 120 can be accomplished via electrophoretic deposition as will be discussed further hereinbelow with respect to FIG. 3. The metal layer 120 can have a thickness of 10 mils (0.25 mm) to 30 mils (0.76 mm), such as 15 mils (0.38 mm) to 25 mils (0.64 mm).

Formation of the metal layer 120 on the electrically conductive coating 118 according to the methods disclosed herein, provides for a metal layer 120 having good bond strength to the electrically conductive coating 118 and ultimately, to the underlying component 110. For instance, in embodiments the bond strength between the metal layer 120 and the electrically conductive coating 118 is 0.5 ksi (3.44 MPa) to 5 ksi (34.47 MPa), such as 1 ksi (6.89 MPa) to 4.5 ksi (31.03 MPa), such as 1.5 ksi (10.34 MPa) to 4 ksi (27.58 MPa), such as 2 ksi (13.79 MPa) to 3.5 ksi (24.13 MPa). In certain embodiments the bond strength is 1.5 ksi (10.34) or 1.0 ksi (6.89). The bond strength can be measured via a flatwise tensile strength test. Suitable flatwise tensile strength tests include ASTM C297 and ASTM C297M. Having the disclosed bond strength between the metal layer 120 and the electrically conductive coating 118 reduces the risk of delamination between the layers during use of the component 110.

Figure 4:
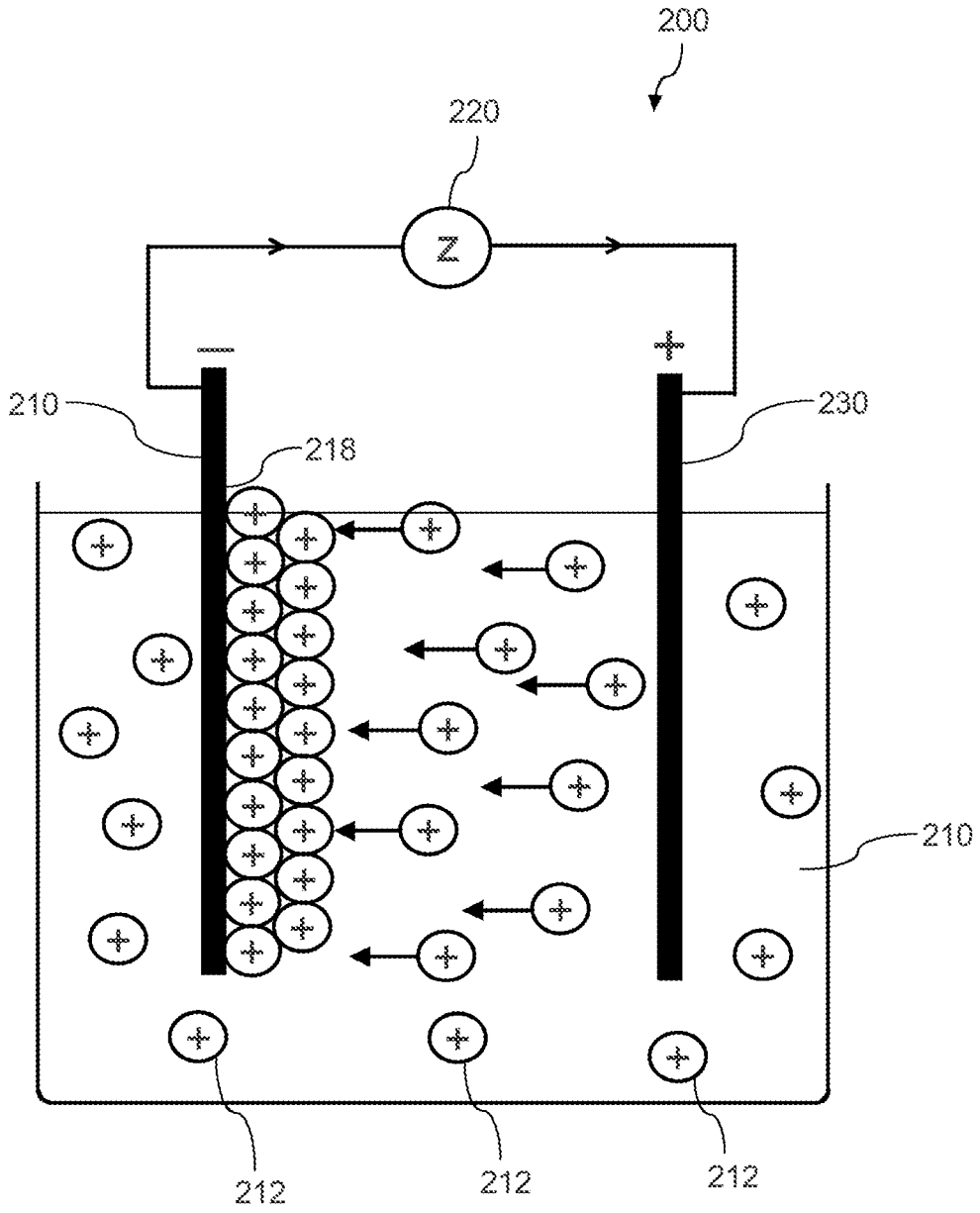
FIG. 4 illustrates a suitable apparatus for performing electrophoretic deposition in accordance with aspects of the present subject matter.

Referring now to FIG. 4, a mechanism 200 for accomplishing electrophoretic deposition is illustrated. However, the disclosure is not limited to the exemplary mechanism 200, and any number of devices or configurations for electrophoretic deposition can be utilized in the method provided herein. As shown, a component 210 having an electrically conductive coating 218 according to the present disclosure is immersed in a suspension 211 and electrically connected to a terminal of a voltage source 220. A second electrode 230 is also submerged in the suspension 211 and connected to the voltage source 220. The suspension 211 includes particles 212 of coating material, here the particles 212 are metal particles, for forming a metal layer as described herein. The suspension 211 further includes a solvent for suspending the particles 212 therein. Suitable solvents can include ethanol, methanol, or other mixtures of alcohols and water. Organic solvents may also be utilized. Additional stabilizers or pH modifiers can also be added to the suspension 211. Suitable pH modifiers can include acids or bases such as nitric acid, hydrochloric acid, acetic acid, stearic acid, ammonium hydroxide, or aluminum hydroxide. The component 210 to be coated is biased with negative DC voltage to attract the particles 212 to the electrically conductive coating 218. After the electrically conductive coating 218 is sufficiently coated with particles 212 forming a metal layer, the DC bias is removed and the component 210 can be removed from the suspension 211. Optionally, the coated component 210 can be dried according to known drying procedures.

Figure 5:
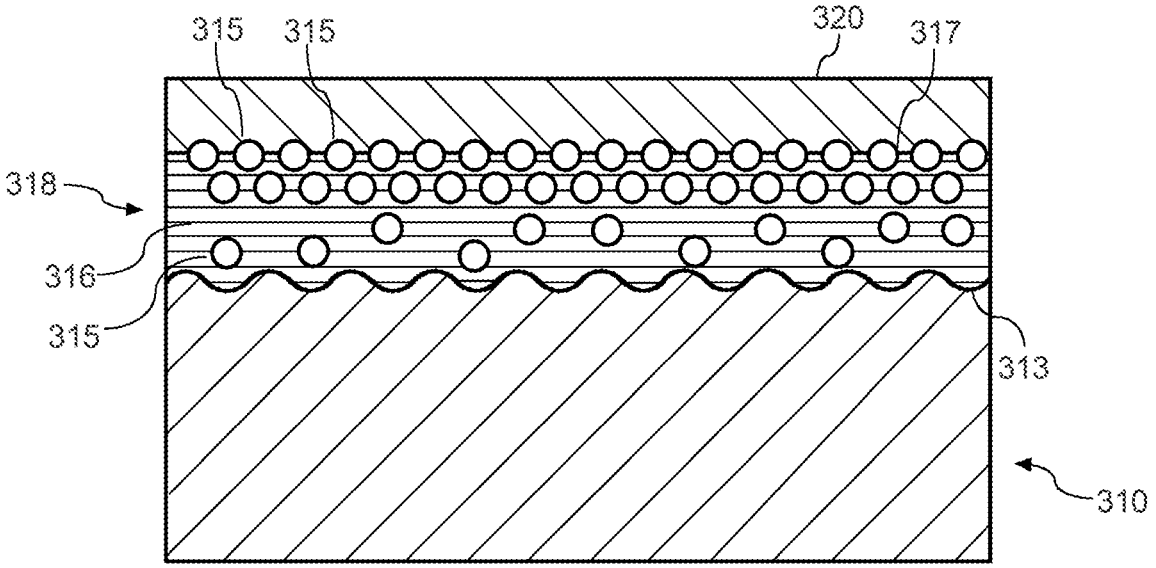
FIG. 5 illustrates a cross-sectional view of a coated component in accordance with aspects of the present subject matter.

Referring now to FIG. 5, in embodiments, the electrically conductive coating 318 can have a higher concentration of metal particles 315 dispersed closer to the outer surface 317 of the electrically conductive coating 318. To achieve such a graded effect, a resin 316 can be applied to the coating region 113 of the component 310 and at least partially cured. Given that the resin 316 is partially cured, additional metal particles 315 can be applied to the resin 316. For example, additional metal particles 315 can be adhered to or incorporated in to resin 316 located along the outer surface 317 of the electrically conductive coating 318. Metal particles 315 can be sprayed, rolled, dipped, or applied to the electrically conductive coating 318 via any suitable method. Disposition of a higher concentration of metal particles 315 on the outer surface 317 of the electrically conductive coating 318, further facilitates deposition of the metal layer 320 on the component 310 during electrodeposition of the metal layer 320. Further, disposition of a higher concentration of metal particles 315 on the outer surface 317 of the electrically conductive coating 318 can improve bond strength between the electrically conductive coating 318 and the metal layer 320.

Figure 6:
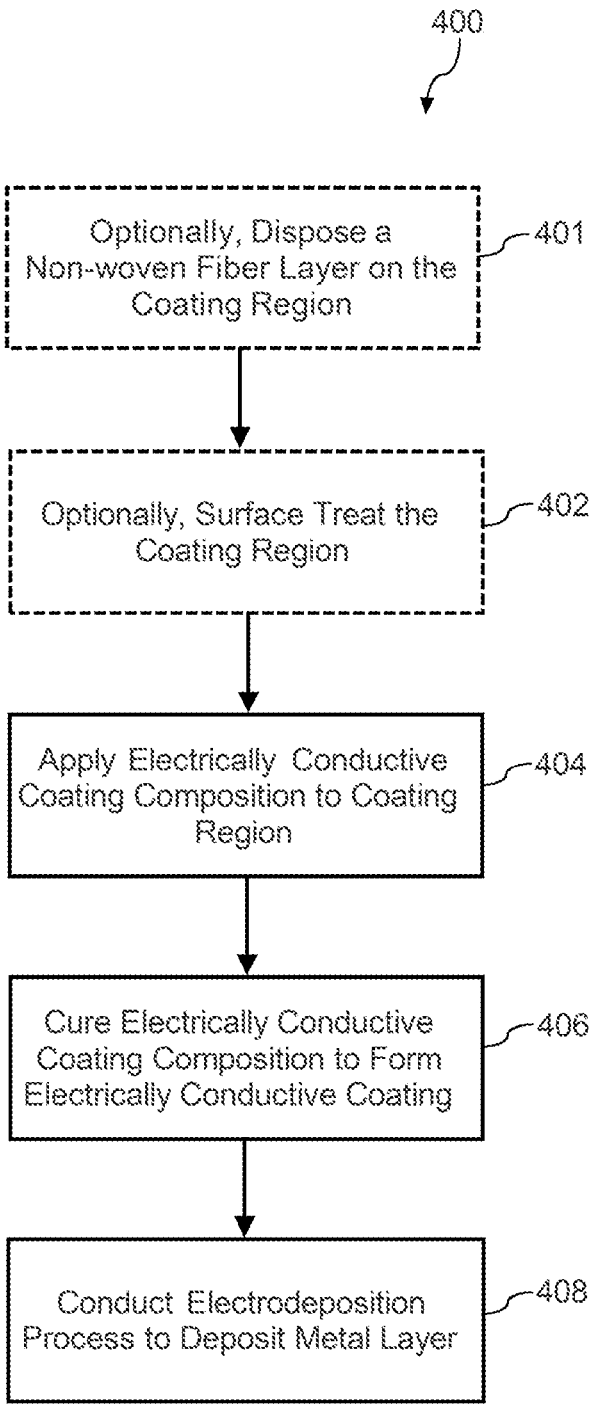
FIG. 6 is a flow-chart depicting a method of coating a component in accordance with aspects of the present subject matter.

Referring now to FIG. 6, a flow diagram of a method 400 of forming a component having a metal layer thereon in accordance with an exemplary aspect of the present disclosure is provided. In certain exemplary aspects, the method 400 of FIG. 6 may be utilized with the exemplary airfoil described above with reference to FIG. 2. However, in other exemplary aspects, the method 400 may be used with any other suitable airfoil and/or guide vane.

At (401), optionally, a non-woven fiber layer can be disposed on the surface of the component. The non-woven fiber layer can include any suitable fibers including carbon fibers, glass fibers, and/or aramid fibers. The fibers can be metal coated, or metal materials can be embedded in the non-woven fiber layer. Without being bound by any particular theory, the non-woven fiber layer can facilitate bonding of the electrically conductive coating to the component. For example, the non-woven fiber layer can act as a filter preventing metal particles in the electrically conductive coating composition from passing to the surface of the component, while allowing for resin to seep through to the surface of the component. In such embodiments, the metal particles remain towards an outer surface of the electrically conductive coating layer which can facilitate electrodeposition of the metal layer, while the resin is able to form a strong bond with the component.

Optionally, at (402), the component is subjected to a surface treatment to define a coating region. Suitable surface treatments include grit blasting and/or sand blasting as disclosed herein. Roughening the surface of the component promotes adherence of the electrically conductive coating.

At (404) an electrically conductive coating composition is applied to the coating region of a component. For example, in the case of the exemplary airfoil provided herein, the electrically conductive coating composition can be applied to the leading edge of the airfoil. As noted, the electrically conductive coating composition includes a resin having metal particles dispersed therein.

At (406) the electrically conductive coating composition is at least partially cured to form the electrically conductive coating. In certain embodiments, the electrically conductive coating composition can be fully cured to its final solid state to form the electrically conductive coating.

At (408) an electrodeposition process is conducted on the component having the electrically conductive coating thereon to deposit a metal layer on the component. For instance, the component having the electrically conductive coating thereon can be subjected to electrophoretic deposition to deposit a metal layer over the electrically conductive coating. Areas of the component can be masked to prevent deposition of the metal layer on undesired regions of the component.

Further aspects are provided by the subject matter of the following clauses:

1. A method for depositing a metal layer on a component, the method comprising: applying an electrically conductive coating composition comprising a resin and metal particles on a coating region of the component; at least partially curing the resin forming an electrically conductive coating; and depositing, via an electrodeposition process, a metal layer on the electrically conductive coating.

2. The method of any preceding clause, wherein the component comprises a foam material.

3. The method of any preceding clause, wherein the component comprises a ceramic matrix composite material or a polymer matrix composite material.

4. The method of any preceding clause, wherein the resin comprises epoxy resin, polyimide resin, polymer-derived ceramic, or combinations thereof.

5. The method any preceding clause, wherein the metal particles comprise Ni, NiCo, NiMo, CoCr, Co, Cu, their alloys, or combinations thereof.

6. The method of any preceding clause, wherein the metal particles have an aspect ratio of 1 to 100.

7. The method of any preceding clause, wherein the metal particles have an average particle size of less than 50 microns.

8. The method of any preceding clause, wherein the metal particles comprise 10 wt. % to 65 wt. % of the electrically conductive coating composition.

9. The method of any preceding clause, wherein the metal layer comprises Ni, NiCo, NiMo, CoCr, Co, Cu, their alloys, or combinations thereof.

10. The method of any preceding clause, comprising, before applying the electrically conductive coating composition, preparing a surface of the component to form the coating region.

11. The method of any preceding clause, wherein preparing the surface of the component comprises grit blasting the surface of the component.

12. The method of any preceding clause, wherein the metal particles are graded throughout the electrically conductive coating such that a higher concentration of metal particles are located towards an outer surface of the electrically conductive coating.

13. The method of any preceding clause, comprising disposing additional metal particles on the outer surface of the electrically conductive coating.

14. The method of any preceding clause, comprising disposing a non-woven fiber layer on the coating region of the component before applying the electrically conductive coating composition.

15. The method of any preceding clause, wherein the component comprises a gas turbine engine component.

16. The method of any preceding clause, wherein the gas turbine engine component comprises an airfoil.

17. The method of any preceding clause, wherein the metal layer is formed on a leading edge of the airfoil.

18. The method of any preceding clause, wherein the leading edge includes a plurality of peaks and valleys.

19. The method of any preceding clause, wherein the metal layer has a thickness of 10 mils to 30 mils.

20. The method of any preceding clause, wherein a bond strength between the metal layer and electrically conductive coating is 0.5 ksi to 5 ksi.

21. A component comprising, an electrically conductive coating comprising resin with metal particles dispersed therein and a metal layer disposed on the electrically conductive coating.

22. The component of any preceding clause, wherein the article comprises a foam material.

23. The component of any preceding clause, wherein the component comprises a ceramic matrix composite material or a polymer matrix composite material.

24. The component of any preceding clause, wherein the resin comprises epoxy resin, polyimide resin, polymer-derived ceramic, or combinations thereof.

25. The component of any preceding clause, wherein the metal particles comprise Ni, NiCo, NiMo, CoCr, Co, Cu, their alloys, or combinations thereof.

26. The component of any preceding clause, wherein the metal particles have an aspect ratio of 1 to 100.

27. The component of any preceding clause, wherein the metal particles have an average particle size of less than 50 microns.

28. The component of any preceding clause, wherein the metal particles comprise 10 wt. % to 65 wt. % of the electrically conductive coating.

29. The component of any preceding clause, wherein the metal layer comprises Ni, NiCo, NiMo, CoCr, Co, Cu, their alloys, or combinations thereof.

30. The component of any preceding clause, wherein the metal particles are graded throughout the electrically conductive coating such that a higher concentration of metal particles are located towards an outer surface of the electrically conductive coating.

31. The component of any preceding clause, comprising a non-woven fiber layer disposed on a surface of the component under the electrically conductive layer.

32. The component of any preceding clause, wherein the component comprises a gas turbine engine component.

33. The component of any preceding clause, wherein the gas turbine engine component comprises an airfoil.

34. The component of any preceding clause, wherein the metal layer is formed on a leading edge of the airfoil.

35. The component of any preceding clause, wherein the leading edge includes a plurality of peaks and valleys.

36. The component of any preceding clause, wherein the metal layer has a thickness of 10 mils to 30 mils.

37. The component of any preceding clause, wherein a bond strength between the metal layer and electrically conductive layer is 0.5 ksi to 5 ksi.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

We claim:

1. A method for depositing a metal layer on a component, the method comprising:

disposing a non-woven fiber layer on a coating region of the component;

applying an electrically conductive coating composition comprising a resin and metal particles on the non-woven fiber layer;

at least partially curing the resin forming an electrically conductive coating; and depositing, via an electrodeposition process, a metal layer on the electrically conductive coating.

2. The method of claim 1, wherein the component comprises a foam material.

3. The method of claim 1, wherein the component comprises a ceramic matrix composite material or a polymer matrix composite material.

4. The method of claim 1, wherein the resin comprises epoxy resin, polyimide resin, polymer-derived ceramic, or combinations thereof.

5. The method of claim 1, wherein the metal particles comprise Ni, NiCo, NiMo, CoCr, Co, Cu, their alloys, or combinations thereof.

6. The method of claim 1, wherein the metal particles have an aspect ratio of 1 to 100.

7. The method of claim 1, wherein the metal particles have an average particle size of less than 50 microns.

8. The method of claim 1, wherein the metal particles comprise 10 wt. % to 65 wt. % of the electrically conductive coating composition.

9. The method of claim 1, wherein the metal layer comprises Ni, NiCo, NiMo, CoCr, Co, Cu, their alloys, or combinations thereof.

10. The method of claim 1, comprising, before applying the electrically conductive coating composition, preparing a surface of the component to form the coating region.

11. The method of claim 10, wherein preparing the surface of the component comprises grit blasting the surface of the component.

12. The method of claim 1, wherein the metal particles are graded throughout the electrically conductive coating such that a higher concentration of metal particles are located towards an outer surface of the electrically conductive coating.

13. The method of claim 12, comprising disposing additional metal particles on the outer surface of the electrically conductive coating.

14. The method of claim 1, wherein the component comprises a gas turbine engine component.

15. The method of claim 14, wherein the gas turbine engine component comprises an airfoil.

16. The method of claim 15, wherein at least a portion of the coating region and the metal layer are formed on a leading edge of the airfoil.

17. The method of claim 16, wherein the leading edge includes a plurality of peaks and valleys.

18. The method of claim 1, wherein the metal layer has a thickness of 10 mils to 30 mils.

19. The method of claim 1, wherein a bond strength between the metal layer and the electrically conductive coating is 0.5 ksi to 5 ksi.

* * * * *